US006854515B2

(12) United States Patent
Matthews et al.

(10) Patent No.: US 6,854,515 B2
(45) Date of Patent: Feb. 15, 2005

(54) WELLHEAD HYDRAULIC DRIVE UNIT

(75) Inventors: Ed Matthews, P.O. Box 327, Kitscoty, Alberta (CA), T0G 2P0; Gregg Lacusta, Lloydminster (CA); Jim Anaka, Lashburn (CA)

(73) Assignees: Innovative Production Technologies, LTD, Calgary (CA); Sabre Machining Ltd., Lloydminster (CA); Ed Matthews, Kitscoty (CA)

( * ) Notice: Subject to any disclaimer, the term of this patent is extended or adjusted under 35 U.S.C. 154(b) by 13 days.

(21) Appl. No.: 10/331,491

(22) Filed: Dec. 31, 2002

(65) Prior Publication Data

US 2004/0112586 A1 Jun. 17, 2004

Related U.S. Application Data

(60) Provisional application No. 60/432,614, filed on Dec. 12, 2002.

(51) Int. Cl.[7] ..... E21B 43/00
(52) U.S. Cl. ..... 166/68.5; 166/77.4
(58) Field of Search ..... 166/383, 77.4, 166/68.5

(56) References Cited

U.S. PATENT DOCUMENTS 2,159,526 A * 5/1939 Humason ..... 166/68.5
3,051,237 A * 8/1962 Corley, Jr. et al. ..... 166/97.5
4,305,461 A * 12/1981 Meyer ..... 166/77.4
4,432,706 A 2/1984 Gilbertson
4,462,464 A * 7/1984 Brown et al. ..... 166/68.5
4,745,969 A * 5/1988 Henderson ..... 166/68.5
4,781,543 A 11/1988 Sommer et al.
4,991,650 A * 2/1991 McLeod ..... 166/72
5,800,063 A 9/1998 Stanley
2003/0066656 A1 * 4/2003 Hughes et al. ..... 166/383

* cited by examiner

*Primary Examiner*—Hoang Dang
(74) *Attorney, Agent, or Firm*—Sughrue Mion, PLLC

(57) ABSTRACT

The present invention provides a wellhead hydraulic drive unit to operate various styles of downhole pumps, which is installed as an integral part of a wellhead thereby eliminating the need for a stuffing box. The wellhead hydraulic drive unit comprises a hollow hydraulic cylinder having a piston positioned therein, a hydraulic fluid supply attached to the hydraulic cylinder for raising the piston within the hydraulic cylinder, a hollow ram slideably received within the inner wall of the hydraulic cylinder and connected to the piston for reciprocation in response to the piston; and a production tube inserted through the ram for enabling well fluid to be discharged from the well.

20 Claims, 2 Drawing Sheets

WELLHEAD HYDRAULIC DRIVE UNIT

Priority is claimed from U.S. Provisional Application Ser. No. 60/432,614, filed Dec. 12, 2002, entitled WELLHEAD DRIVE UNIT listing Ed MATTHEWS, Gregg LACUSTA and Jim ANAKA as inventors.

FIELD OF THE INVENTION

The present invention relates to a drive mechanism associated with artificial lift systems used in the production of oil and other fluids contained within underground formations. More specifically, this invention relates to a wellhead hydraulic drive unit that is installed as an integral part of a wellhead.

BACKGROUND OF THE INVENTION

Fluid production wells having insufficient pressure are unable to flow liquids to the surface by natural means. Such wells require some form of energy or lift to transfer fluids to the surface.

Several artificial lift systems exist to extract the liquids from liquid-bearing reservoirs. In the case of lifting oil from wells, conventional lifting units include the beam pump and the surface hydraulic piston drive. Both of these lift units are situated at the surface of the well and lift fluid to the surface by "stroking" production tubing or rods inside production casing and/or well casing. The production tubing or rods is connected to a wellbore pump configuration, comprising a chamber and a check valve, which allows fluid to enter on the down-stroke and to be lifted to the surface on the up-stroke. These conventional lift units are supplied power from combustion engines or electric drives.

Beam pumps and surface hydraulic piston drives come in many sizes and are used extensively worldwide. U.S. Pat. Nos. 3,376,826; 3,051,237 and 4,296.678 are all examples of the use of a beam drive for a sucker string actuated pump. U.S. Pat. No. 4,403,919 is an example of a surface powered hydraulic pumping unit.

There are many drawbacks associated with the use of conventional beam pumps and surface hydraulic piston drives. These units are large, obtrusive and unsightly in many sensitive regions. Further, the tubing and/or rods from within the wellbore must extend outside the well through a stuffing box to connect the drive units to same. The stuffing box prevents the wellbore fluids from escaping to the surrounding surface environment, however, rarely is this 100% successful thereby resulting in hydrocarbon contamination of the ground surrounding the wellhead.

Additional drawbacks to the use of conventional beam pumps and surface hydraulic piston drives are as follows. These units present a hazard to workers in the surrounding area as a result of exposure to surface moving parts. Further, beam pumps often experience alignment problems resulting in stress on the rods, undue wear and eventual failure. Finally, there are numerous dangers to personnel associated with assembly, transportation, installation, operation and maintenance due to the size of the units and their many moving parts.

U.S. Pat. No. 4,745,969 provides for a hydraulic/mechanical system for pumping oil wells that has a surface unit that can be hung inside of the well casing, so that there are no mechanical working parts outside of the well casing, except for surface pipeline connections. However, the '969 in-casing hydraulic jack system must be suspended from 20 to 40 feet below the surface of the ground, depending upon the required stroke. Further, the hydraulic jack unit is sealed within the well casing resulting in a casing interior space for collecting reservoir fluid above the sealing means. This could result in leakage from the casing interior space to the environment, especially when lifting the hydraulic jack from the casing.

SUMMARY OF INVENTION

The present invention provides a wellhead hydraulic drive unit to operate various styles of downhole pumps. The drive unit is installed as an integral part of the wellhead thereby eliminating the need for a stuffing box. Thus, hydrocarbon leakage from the wellhead drive unit is eliminated. Further, alignment issues through the wellhead and stuffing box associated with beam pumps and surface hydraulic drives are also eliminated.

The wellhead hydraulic drive unit of the present invention is easier and safer to assemble, transport, install, operate and maintain due to its compact size and minimal moving parts. This results in lower installation and retrieval costs. Installation can be completed using a conventional service rig or a location specific small mast unit.

It is important to note that well control is maintained throughout installation. There are no moving parts at the surface or above the wellhead. Once installed, the wellhead hydraulic drive unit of the present invention will have an extremely low profile. The wellhead hydraulic drive unit of the present invention can be easily installed in slant wells as well as horizontal or vertical wells.

The wellhead hydraulic drive unit can be used in a variety of production applications; for example, heavy oil wells, high viscosity and low inflow wells, light oil high production wells, gas well dewatering, steam-assisted gravity drainage (SAGD) wells, slant wells, stroking production tubing or rods, water injection applications, sand disposal applications and pulse wells to stimulate production.

In accordance with the present invention, an in-casing wellhead hydraulic drive unit for operating a downhole production pump via pump connecting means is provided, which hydraulic drive unit comprises:

- a hydraulic cylinder having top and bottom ends, an inner wall and a piston positioned within the inner wall for reciprocation within the hydraulic cylinder;
- hydraulic fluid supply means attached to the hydraulic cylinder for producing reciprocation of the piston within the hydraulic cylinder;
- ram means having a top and bottom end and an annulus therethrough, slideably received within the inner wall of the hydraulic cylinder and connected to the piston for reciprocation in response to the piston; and
- production tube means inserted through the annulus of the ram means and connected to the hydraulic cylinder for enabling well fluid to be discharged from the well.

In a preferred embodiment, the in-casing wellhead hydraulic drive unit further comprises a means for mounting the hydraulic drive unit to the wellhead, said mounting means further comprising a hanger means attached to the hydraulic cylinder for landing the hydraulic cylinder within the wellhead. The hydraulic cylinder can be landed in the wellhead such that the top end of the hydraulic cylinder is positioned below the wellhead, within the wellhead or above the wellhead. The bottom end of the hydraulic cylinder is always contained within the well casing.

In another preferred embodiment, the bottom end of the ram means is threaded and the pump connecting means threadably receives the bottom end of the ram means. In the alternative, a coupling means, which couples the ram means to the pump connecting means, is used.

DETAILED DESCRIPTION

Figure 1:
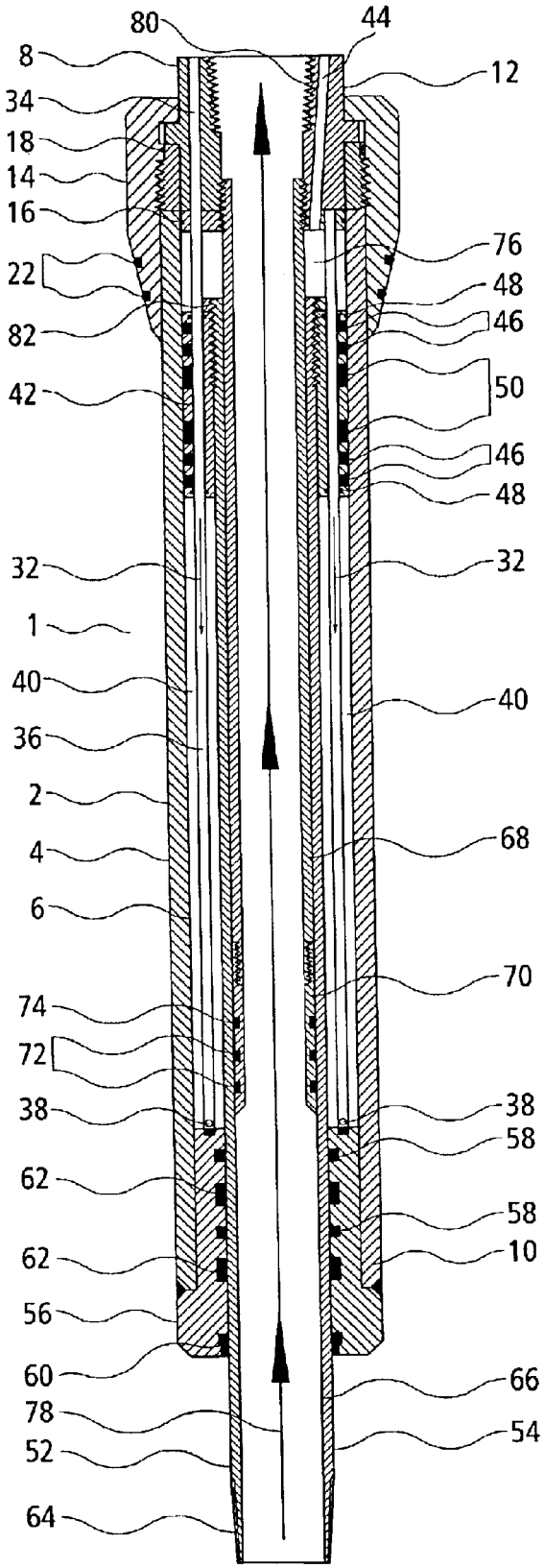
FIG. 1 is a cross-sectional view of the wellhead hydraulic drive unit in accordance with a preferred embodiment of the invention.

With reference to FIG. 1, the wellhead hydraulic drive unit according to the present invention is shown designated generally by the reference numeral 1. The various parts which make up the drive unit 1 are for the most part housed within hydraulic cylinder 2. Hydraulic cylinder 2 is comprised of cylinder outer wall 4, cylinder inner wall 6, cylinder top end 8 and cylinder bottom end 10.

At cylinder top end 8 is situated top gland 12. Hanger 14 is threaded onto cylinder top end 8 of the hydraulic cylinder 2 to retain top gland 12 to hydraulic cylinder 2. Top gland seal 16 seals top gland 12 to cylinder inner wall 6 and hanger seal 18 seals hanger 14 to cylinder outer wall 4.

It should be noted that hanger 14 profiles vary with different wellheads and are manufactured accordingly. Where applications restrict the use of hanger 14 in the wellhead itself, a landing spool (not shown) can be used. The landing spool is bolted on to the wellhead and the hanger 14 of the wellhead hydraulic drive unit 1 will then be landed within the landing spool.

The wellhead hydraulic drive unit 1 can also be directly bolted to the wellhead by means of a flange (not shown), where well control precautions are not an issue. The flange means would be directly threaded onto the wellhead hydraulic drive unit 1 and then bolted directly onto the wellhead.

The wellhead hydraulic drive unit 1 is operated by hydraulic power supplied from an outside source, capable of delivering and operating from 500 psi to 4,000 psi. Hydraulic fluid 32 is delivered to the wellhead hydraulic drive unit 1 via top gland 12. Hydraulic fluid enters in through hydraulic fluid port 34 and flows down through internal porting (not shown) in top gland 12. The hydraulic fluid 32 is then routed through the top gland porting down through a plurality of feed tubes 36 attached to top gland 12 and out feed tube ports 38 into lower annular area 40.

Hydraulic pressure in lower annular area 40 delivers force to main piston 42 for the upstroke or retraction movement. Down stroke movement or extension is normally achieved by tubing or rod weight from below (not shown). In applications where the tubing or rod weight is insufficient, hydraulic fluid can also be delivered to the top side of the main piston 42 through another hydraulic fluid port/vent 44 to actuate downward force.

A plurality of piston seals 46 provides sealing between main piston 42 and cylinder inner wall 6. A plurality of feed tube seals 48 provides sealing between main piston 42 and feed tubes 36. Wear rings 50 help provide main piston 42 alignment to cylinder inner wall 6 of hydraulic cylinder 2.

Main piston 42 is threaded onto cylindrical ram 52 and has a non-rotational lock ring 82. This allows for the wellhead hydraulic drive unit to provide torque to down hole tools where applicable. The torque is applied to hydraulic cylinder 2 and transmitted out to cylindrical ram 52 via main piston 42 and feed tubes 36. It is designed to deliver either right or left hand torque in the fully open or fully closed positions only.

Cylindrical ram 52 has ram outer wall 54 and ram inner wall 66. Cylindrical ram 52 moves up and down within hydraulic cylinder 2 relative to main piston 42. Cylindrical ram 52 extends the length of hydraulic cylinder 2 from main piston 42 through cylinder bottom end 10 of hydraulic cylinder 2.

Cylindrical ram bottom 64 is threaded to allow for connecting to a downhole pump via pump connecting means (not shown). Pump connecting means such as tubing joints, continuous tubing, sucker rods and continuous rods can either threadably receive threaded cylindrical ram bottom 64 or various crossover adapter designs can be used to couple the ram bottom 64 with pump connecting means. The design and type of pump will determine crossover design of the coupling adapter.

At cylinder bottom end 10, end gland 56 is welded in place to cylinder inner wall 4. A plurality of end gland seals 58 provides sealing between cylindrical ram 52 and end gland 56. Wiper 60 wipes cylindrical ram 52 clean to keep contaminants from entering end gland seals 58. Wear rings 62 help provide cylindrical ram 52 alignment inside end gland 56.

Housed within cylindrical ram 52 is production tube 68. Production tube 68 is threaded into top gland 12 to create a positive pressure seal. Attached to production tube 68 is production tube piston 70. A plurality of production tube seals 72 provides sealing between production tube piston 70 and ram inner wall 66. An additional production tube seal 74 also provides sealing between production tube piston 70 and cylindrical ram 52, but functions to further seal out hydraulic fluid only from the top side in upper annular area 76.

As production fluid 78 is pumped from the bottom of the well to surface, it enters into the inner diameter of cylindrical ram 52 as shown by the arrow. As production fluid enters into cylindrical ram 52, it is produced up through the wellhead hydraulic drive unit 1 by means of the production tube piston 70 and through production tube 68. Production fluid 78, after passing through production tube 68 then enters top gland 12 and exits out to the surface via a flow line (not shown) which is connected to top gland 12 by threading into top gland thread 80.

Figure 2:
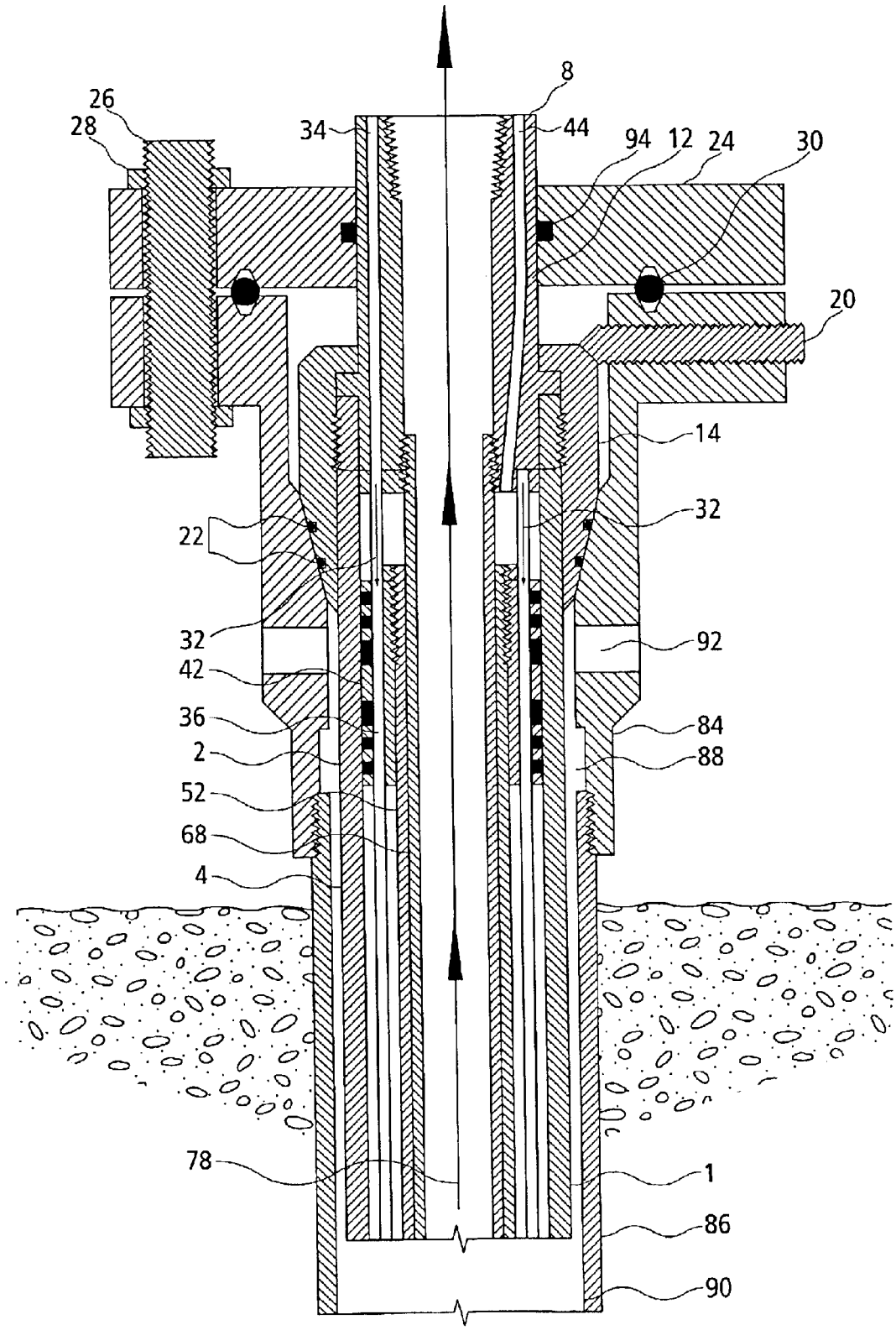
FIG. 2 is a cross-sectional view of the top end of the wellhead hydraulic drive unit inserted in a wellhead and well casing, in accordance with the present invention.

FIG. 2 shows the wellhead hydraulic drive unit 1 installed in a well casing. The installation of the wellhead hydraulic drive unit 1 is unique in that it is installed as an integral part of the wellhead. As a result of this, the well control features associated with the wellhead are optimized.

With reference now to FIG. 2, wellhead 84 is shown attached to well casing 86. The wellhead hydraulic unit 1 is lowered into the wellhead 84 and well casing 86 until hanger 14 is landed in place in wellhead 84. The lower portion of the well hydraulic drive unit 1 now hangs inside well casing annulus 88 leaving sufficient space between the cylinder outer wall 4 of hydraulic cylinder 2 and the casing inner wall 90 to allow venting of casing annular gas to the surface through wellhead port 92. A build up of gas pressure inhibits the flow of production fluids from the formation. Thus it is important to have the means for alleviating gas pressure.

It is further important to have sufficient space between cylinder outer wall 4 and casing inner wall 90 in order to determine fluid levels in the well bore to maximize fluid production.

Hanger 14 is secured in wellhead 84 by four equally spaced lag screws 20 and sealed to the wellhead 84 by a plurality of wellhead seals 22. Once hanger 14 is landed in the wellhead 84, top cover flange 24 is then installed on wellhead 84 by a plurality of flange bolts 26 and secured down with flange nuts 28. Top cover flange 24 is sealed to the wellhead 84 by API seal ring 30. Cylinder top end 8 of hydraulic cylinder 2 is sealed to top cover flange 24 by top cover flange seal 94.

In practice, hydraulic fluid 32 is supplied at top gland 12 and fed through one or more feed tubes 36 having hydraulic fluid ports 34 at the bottom for hydraulic flow. This hydraulic fluid path provides for main piston 42 upstroke or hydraulic cylinder retraction. Hydraulic fluid can also be supplied directly through the top gland 12 to the top side of the main piston 42 via a second hydraulic fluid port/vent 44 for piston downstroke or hydraulic cylinder extension.

The up and down stroking movement actuates the downhole pump allowing for production fluid 78 to surface. The production fluid 78 passes up through the downhole production tubing, through the cylindrical ram 52, through the production tube piston 70 and production tube 68, and finally through the top gland 12 to exit at the surface via a vent or flow line (not shown) attached to the wellhead hydraulic drive unit 1.

Hydraulic pressure to the main piston 42 is supplied from a surface pump via a control line connected to the cylinder top end 8 of the hydraulic cylinder (not shown). The power for the hydraulic pump can either be electric and/or internal combustion motor.

While various embodiments in accordance with the present invention have been shown and described, it is understood that the same is not limited thereto, but is susceptible of numerous changes and modifications as known to those skilled in the art, and therefore the present invention is not to be limited to the details shown and described herein, but intend to cover all such changes and modifications as are encompassed by the scope of the appended claims.

We claim:

1. An in-casing wellhead hydraulic drive unit for operable connection to a downhole production pump via pump connecting means, comprising:

(a) a hydraulic cylinder configured for placement within and in landed engagement with an uppermost portion of a wellhead casing, having top and bottom ends, an inner wall and a piston positioned within said inner wall for reciprocation within the hydraulic cylinder;

(b) hydraulic fluid supply means coupled to the hydraulic cylinder for raising of the piston within the hydraulic cylinder;

(c) ram means having a top and bottom end and a bore therethrough, slideably received within the inner wall of the hydraulic cylinder and operably connected to the piston for reciprocation in response to the piston; and (d) stationary production tube means, inserted through the bore of the ram means and connected to the hydraulic cylinder for enabling well fluid to be discharged from the well.

2. An in-casing wellhead hydraulic drive unit as claimed in claim 1, further comprising means for mounting the hydraulic drive unit in a wellhead.

3. An in-casing wellhead hydraulic drive unit as claimed in claim 2 wherein said means for mounting the hydraulic drive unit in the wellhead comprises a hanger means attached to the hydraulic cylinder for landing the hydraulic cylinder within the wellhead.

4. An in-casing wellhead hydraulic drive unit as claimed in claim 3 wherein said hanger means is threaded onto the top end of said hydraulic cylinder.

5. An in-casing wellhead hydraulic drive unit as claimed in claim 3 wherein said means for mounting the hydraulic drive unit in the wellhead further comprises a top cover flange slideable over the top end of the hydraulic cylinder, said top cover flange being adapted to be fixedly attached to the wellhead.

6. An in-casing wellhead hydraulic drive unit as claimed in claim 2 wherein said means for mounting the hydraulic drive unit in the wellhead comprises a landing spool attached to the wellhead and a hanger means attached to the hydraulic cylinder for landing within the landing spool.

7. An in-casing wellhead hydraulic drive unit as claimed in claim 2 wherein said means for mounting the hydraulic drive unit in the wellhead comprises a flange means attached to the hydraulic cylinder.

8. An in-casing wellhead hydraulic drive unit as claimed in claim 1 wherein said top end of said ram means is threaded and said piston threadably receives said top end of said ram means.

9. An in-casing wellhead hydraulic drive unit as claimed in claim 1 wherein said hydraulic fluid supply means comprises a gland having a plurality of hydraulic feed tubes attached thereto.

10. An in-casing wellhead hydraulic drive unit as claimed in claim 1 wherein said bottom end of said ram means is threaded and said pump connecting means threadably receives said bottom end of said ram means.

11. An in-casing wellhead hydraulic drive unit as claimed in claim 1 further comprising a coupling means which couples said ram means to said pump connecting means.

12. An in-casing wellhead hydraulic drive unit as claimed in claim 9 wherein said production tube means is threaded and said gland of the hydraulic fluid supply means threadably receives said production tube means.

13. An in-casing wellhead hydraulic drive unit as claimed in claim 1 further comprising a production tube piston attached to said production tube means.

14. An in-casing wellhead hydraulic drive unit as claimed in claim 1 wherein said pump connecting means comprises tubing joints, continuous tubing, sucker rods or continuous rods.

15. An in-casing wellhead hydraulic drive unit as claimed in claim 1, said hydraulic cylinder having a plurality of passages therethrough through which hydraulic tubing extends, said hydraulic tubing adapted to pressurize an annular area below said piston so as to cause said piston and ram means to rise, said hydraulic fluid supply means in fluid communication with said hydraulic tubing.

16. An in-casing wellhead hydraulic drive unit as claimed in claim 9, said gland having hydraulic passage means to allow an annular area above said piston to be pressurized to thereby lower said piston means within said hydraulic cylinder.

17. An in-casing wellhead hydraulic drive unit for operable connection to a downhole production pump via pump connecting means, comprising:

(a) a hydraulic cylinder configured for placement within and landed engagement with an uppermost portion of a wellhead casing, having top and bottom ends, an inner wall and a piston positioned within said inner wall for reciprocation within the hydraulic cylinder, said piston having a plurality of passages therethrough through which hydraulic tubing extends, said hydraulic tubing adapted to pressurize an annular area below said piston so as to cause said piston to rise when said annular area is pressurized by hydraulic fluid from said hydraulic tubing;

(b) hydraulic fluid supply means coupled to the hydraulic tubing for raising of the piston within the hydraulic cylinder;

(c) ram means having a top and bottom end and a bore therethrough, slideably received within the inner wall of the hydraulic cylinder and operably connected to the piston for reciprocation in response to the piston; and (d) production tube means inserted through the bore of the ram means and connected to the hydraulic cylinder for enabling well fluid to be discharged from the well via said production tube.

18. An in-casing wellhead hydraulic drive unit as claimed in claim 17, wherein said hydraulic drive unit and said production tube is located along a longitudinal axis of said wellhead and co-axially therewith, and said well fluid is discharged from said production tube along said longitudinal axis of said wellhead.

19. An in-casing wellhead hydraulic drive unit as claimed in claim 18, wherein said hydraulic fluid supply means is coupled to the hydraulic drive unit for producing reciprocation of said piston within the hydraulic supply unit.

20. An in-casing wellhead hydraulic drive unit as claimed in claim 18, wherein said hydraulic fluid supply means is coupled to the hydraulic drive unit so as to permit reciprocation of said piston within the hydraulic supply unit.

* * * * *